United States Patent [19]

Deane et al.

[11] Patent Number: 4,848,476

[45] **Date of Patent: * Jul. 18, 1989**

[54] DRILL BIT HAVING OFFSET ROLLER CUTTERS AND IMPROVED NOZZLES

[75] Inventors: John D. Deane; Paul E. Pastusek, both of Houston, Tex.

[73] Assignee: Reed Tool Company, Houston, Tex.

[ * ] Notice: The portion of the term of this patent subsequent to May 14, 2002 has been disclaimed.

[21] Appl. No.: 162,289

[22] Filed: Feb. 29, 1988

Related U.S. Application Data

[63] Continuation of Ser. No. 908,080, Sep. 15, 1986, Pat. No. 4,741,406, which is a continuation-in-part of Ser. No. 553,937, Nov. 21, 1983, Pat. No. 4,611,673, which is a continuation-in-part of Ser. No. 133,164, Mar. 24, 1980, abandoned.

[51] Int. Cl.[4] ..... E21B 10/18

[52] U.S. Cl. ..... 175/340

[58] Field of Search ..... 175/340, 339, 331

[56] References Cited

U.S. PATENT DOCUMENTS

| | | | |
|---|---|---|---|
| 1,922,436 | 8/1933 | Herrington | 175/340 |
| 1,990,007 | 2/1935 | Sperry | 175/340 |
| 2,098,758 | 11/1937 | Reed | 175/340 |
| 2,184,065 | 12/1939 | Zublin | 175/340 X |
| 2,244,617 | 6/1941 | Hannum | 175/340 |
| 2,644,671 | 7/1953 | Ingram | 175/340 |
| 2,815,936 | 12/1957 | Peter et al. | 175/340 |
| 3,014,544 | 12/1961 | Steen | 175/340 |
| 3,137,354 | 6/1964 | Crawford et al. | 175/340 |
| 3,823,789 | 7/1974 | Garner | 175/340 |
| 3,842,921 | 10/1974 | Dill et al. | 175/374 |
| 4,106,577 | 8/1978 | Summers | 175/340 |
| 4,222,447 | 9/1980 | Cholet | 175/340 |
| 4,239,087 | 12/1980 | Castel et al. | 175/340 |
| 4,513,829 | 4/1985 | Coates | 175/339 |
| 4,516,642 | 5/1985 | Childers et al. | 175/340 |
| 4,546,837 | 10/1985 | Childers et al. | 175/340 |
| 4,741,406 | 5/1988 | Deane et al. | 175/340 |

FOREIGN PATENT DOCUMENTS

| | | | |
|---|---|---|---|
| 38125 | 10/1981 | European Pat. Off. | 175/340 |
| 1104310 | 2/1968 | United Kingdom | 175/340 |

*Primary Examiner*—Hoang C. Dang

*Attorney, Agent, or Firm*—Dodge Bush & Moseley

[57] ABSTRACT

A triple cone drill bit (10, 10A) comprising a plurality of conical roller cutters (16, 16A) having hard metal cutting elements thereon and being so positioned relative to each other that their rotational axes are offset from the rotational axis of the drill bit (10, 10A), and a drilling fluid nozzle system for directing a pressurized fluid stream (76, 76A) across certain of the cutting elements and thereafter against the formation generally at the bottom of the well bore so that when the drill bit (10, 10A) is used in its most advantageous areas, such as the soft, medium-soft and plastic formations, the nozzle system prevents "balling up" of the cutters and greatly increases the drilling efficiency of the bit. In one embodiment (FIGS. 15–20) the drill bit body (12A) has vertically extending recessed portions (21A) formed at the junctures (19A) of the lugs (15A) to provide flow passageways for the upward flow of drilling fluid and entrained cuttings.

3 Claims, 10 Drawing Sheets

DRILL BIT HAVING OFFSET ROLLER CUTTERS AND IMPROVED NOZZLES

CROSS-REFERENCE TO OTHER APPLICATIONS

This application is a continuation of application Ser. No. 908,080, filed Sept. 15, 1986, now U.S. Pat. No. 4,741,406 issued May 3, 1988, which is a continuation-in-part of U.S. patent application Ser. No. 553,937, filed Nov. 21, 1983, now U.S. Pat. No. 4,611,673, issued Sept. 16, 1986 for Drill Bit Having Offset Roller Cutters and Improved Nozzles; which is a continuation-in-part of application Ser. No. 133,164, filed Mar. 24, 1980 for Rolling Cutter Drill Bit, now abandoned.

BACKGROUND OF THE INVENTION

This invention relates to a rotary drill bit for drilling oil and gas wells in the earth, and more particularly to a rotary drill bit comprising generally conical roller cutters having cutting elements thereon which engage and "drill" the formation.

Cutting elements may be of two principal types; namely (1) milled tooth type which are relatively long, wide teeth having tapering sides formed by machining a steel roller cutter body, and (2) insert type which are generally cylindrical studs or inserts of tungsten carbide material press fit into bores drilled in a steel roller cutter body. Rotary drill bits are characterized as either "milled tooth" bits or "insert" bits, depending on which type of cutting element is used. A conventional "milled tooth" bit is shown in U.S. Pat. No. 2,148,372 and a conventional "insert" bit is shown in U.S. Pat. No. 2,687,875.

Roller cone rotary drill bits are the most widely used of the various kinds of oil field drill bits, because they offer satisfactory rates of penetration, as measured in feet per hour, in drilling most commonly encountered formations. Milled tooth bits, for example, present an aggressive cutting structure for providing relatively high rates of penetration in soft formations. Soft formations are typically encountered "high in the hole" (e.g., 0 to 5000 feet deep). Moreover, while the teeth are of steel and thus subject to relatively rapid wear due to abrasion by the formation and erosion by the high velocity drilling fluid at the bottom of the well bore, the time required for tripping the drill string in and out of the well bore to replace a worn bit is relatively low. Accordingly, in drilling soft formations, the milled tooth bit's high rate of penetration outweighs its replacement cost (i.e., bit cost plus trip time cost).

In contrast, insert drill bits, which have relatively small tungsten carbide studs or inserts of generally cylindrical or conical shape having a blunt tip, are successful in drilling medium and hard formations. Such formations are typically encountered "deep in the hole". The success of insert drill bits in hard formations is due to the nature of the drilling action of such bits and their relatively long useful life as measured in the number of feet of formation drilled. As opposed to the teeth of milled tooth bits which drill principally by means of a dragging, scrapping or gouging action, insert bits drill by means of a compressive loading action in which the inserts apply high point loads to the formation. Medium and hard formations, which are typically brittle, crack or fracture in compression under such point loads. Moreover, tungsten carbide, from which the inserts are formed, has high compressive strength and abrasion resistance for extended bit life. In deep hole drilling, reducing the number of relatively time consuming (and thus costly) trips for bit replacement is critical in reducing overall drilling costs.

In February, 1970, a new bit design was patented by P. W. Schumacher, Jr. (U.S. Pat. No. 3,495,668) which incorporated offset axis cutters to provide some measure gouging and scraping cutting action in the drill bit. A subsequent patent, U.S. Pat. No. 3,696,876, issued to Ott in October, 1972, also disclosed a similar invention wherein offset axis cutting elements were incorporated into an insert bit.

Drilling bits incorporating the novel combination of offset cutters and tungsten carbide inserts were successfully introduced by the assignee of the present invention, Reed Rock Bit Company, in 1970, and have become a commonly used type of drill bit in the drilling industry over the past ten years. This second generation of drill bits utilize offset axes and tungsten carbide insert and are particularly advantageous in soft to medium-soft formations by reason of their imparting of some measure of gouging and scraping action to the cutting action of the bit which enhances the drilling efficiency and rate of penetration of the bit in these formations. The amount of offset utilized in these bits ranges on the order of from about 1/64 to about 1/32 inch offset per inch of drill bit diameter. For instance, a $7\frac{7}{8}$ inch bit having offset would have from $\frac{1}{8}$ inch to $\frac{1}{4}$ inch total offset of the cutters.

Conventional drilling bits currently on the market are limited in the amount of offset introduced into the cutters to about 1/32 inch of offset per inch of diameter. Thus, the maximum amount of offset utilized in these soft formations bits currently runs about $\frac{1}{4}$ inch in a $7\frac{7}{8}$ inch diameter bit. During this ten year period when offset axis insert bits have been made commercially successful, those skilled in the art of drill bit technology generally have followed the principle that any additional offset in the cutters above about 1/32 inch per inch of bit diameter would not add any significant efficiency or increased drilling rate to the bit, but would increase the tendency of inserts to fail under the shear forces such increased offset would introduce. Thus, those skilled in the art have restricted their insert bit designs to having an offset range of from zero to 1/32 inch per inch of bit diameter. In addition, as the amount of offset is increased and some measure of drag cutting action is imparted to the drill bit, there is an accompanying increased tendency of certain types of formations (i.e., so-called "sticky" formations) to adhere to the roller cutters. Over time, this can result in "bitballing" in which a thick layer or coating of cut formation covers the roller cutters, limiting the depth of penetration of the cutting elements into the formation and reducing rates of drilling penetration.

Moreover, one drilling application for which neither conventional milled tooth nor insert bits have been satisfactory has been the deep hole drilling of medium and hard formations, such as Mancos shale and Colton sandstone, which become relatively ductile or plastically deformable under extreme "over balanced" conditions. Overbalance occurs when the hydrostatic pressure at the bottom of the column of drilling fluid in the well bore exceeds the pore pressure of the fluid in the formation surrounding the well bore bottom. This pressure differential causes certain otherwise brittle formations to become ductile. When a conventional insert bit is used to drill such formations, the inserts tend to deform rather than fracture the formation and thus the rate of penetration of the bit is relatively slow. When tooth bits are used to drill such a formation, they are rapidly worn and thus provide an unsatisfactory useful life. Moreover, over balance tends to cause "chip hold down" in which cuttings from the formation are held at the well bore bottom rather than carried away by the drilling fluid.

Conventional nozzle systems are generally of two types. The oldest type, such as shown in U.S. Pat. No. 2,244,617, utilizes large, relatively unrestricted fluid openings in the bit body directly above the roller cutters to allow a low pressure flow of the drilling fluid to impinge directly on the roller cutter bodies and to flow around the roller cutters to the bottom of the bore hole. By necessity, this is a low volume, low velocity flow since the fluid stream impinges directly upon the cutter face, and erosion of the cones by the fluid stream would be a serious problem under these circumstances. The second type of conventional bit fluid system comprises the "jet" bits. In a jet bit, a high velocity stream of fluid is directed by a nozzle in the bit body against the formation face without impinging any cutting elements or any other portion of the bit. Impingement of the steel roller cutter body by the stream would result in significant erosion. In some instances, the so-called jet bits have fluid nozzles extending from the bit bodies to a point only a fraction of an inch above the formation face to maximize the hydraulic energy of the fluid stream impinging the formation face. Thus, while the stream of drilling fluid may at least partially clean the formation before being engaged by the roller cutter, it does not clean the roller cutters.

SUMMARY OF THE INVENTION

Among the several objects of this invention may be noted the provision of a rotary drill bit providing satisfactory rates of penetration together with a satisfactory useful life in drilling most commonly encountered formations including formations which become ductile or plastically deformable under over balance conditions; the provisions of such a drill bit which has improved nozzles for cleaning the roller cutters even when drilling ductile or sticky formations; the provision of such a drill bit having a heretofore unknown large degree of offset; and the provision of such a drill bit in which the roller cutter and the formation are subject to separate cleaning actions immediately prior to their engagement for enhanced cutting action.

Briefly, the rotary drill bit of this invention comprises a bit body adapted to be detachably secured to a drill string for rotating the bit and to receive drilling fluid under pressure from the drill string, the bit body having a plurality of spaced apart, depending legs at its lower end, and a plurality of nozzles, one for each of said legs for exit of the drilling fluid from the body. The bit further comprises a plurality of roller cutters, one for each of said legs, rotatably secured to the legs at the lower end thereof, each roller cutter comprising a generally frustoconical cutter body and a plurality of powder metallurgy composite cutting elements secured to the cutter body. The roller cutters are so mounted on the legs of the bit body that the apices of the roller cutters are positioned generally toward a central portion of the bit body with the axes of rotation of the roller cutters spaced from the longitudinal centerline of the bit body a relatively large offset distance greater than that of the above described conventional drill bits, whereby some measure of drag motion of the cutting elements across the formation at the bottom of the well bore is imparted thereto which results in enhanced drill bit cutting action but also an accompanying increased tendency of the cut formation to adhere to the roller cutters in certain formations. Each of the nozzles of the bit has passaging therein directing the drilling fluid under pressure to flow downwardly in a stream toward the cutter body of one of the roller cutters along a line generally adjacent to its cutter body, the drilling fluid impinging at least some of the cutting elements on the roller cutter and thereafter impinging the formation generally at the bottom of the well bore, whereby the formation and the cutting elements impinged by the stream are subjected to separate cleaning actions immediately prior to their engagement for presenting clean engagement surfaces to further enhance the drill bit cutting action.

Stated in different terminology, the nozzle passaging directs the drilling fluid under pressure to flow downwardly in a stream so angled and positioned relative to one of the roller cutters that as this roller cutter rotates cutting elements thereon enter the stream for being cleaned thereby and then exit the stream prior to engaging the formation. After flowing past the cutting elements, the stream of drilling fluid impinges the formation generally at the bottom of the well bore. As earlier described, the formation and the cutting elements impinged by the stream are thus subjected to separate cleaning actions immediately prior to their engagement for presenting clean engagement surfaces to further enhance the drill bit cutting action.

The present invention utilizes a unique insert bit design having a relatively large degree of offset or offset distance in the cutting structure exceeding those ranges utilized in conventional offset axis insert bits such as the above described conventional bits. It was found through extensive experimentation that when an amount of offset equal to or greater than 1/16 inch per inch of bit diameter was introduced into a tri-cone insert bit, the rate of penetration and bit performance can be significantly increased. For some reason unknown to the inventor, the penetration rate and drilling efficiency of an offset insert bit was found not to increase from the commonly accepted optimum offset of about 1/32 inch offset per inch of bit diameter up to about 1/16 inch offset per inch of bit diameter.

In addition to the aforementioned unique drill bit construction, the present invention also embodies a new and unique nozzle jetting system for directing drilling fluid against cutting elements on the roller cutters to clean them and thereafter against the face of the formation to clean it. This nozzle system utilizes directed nozzles to direct the stream of pressurized drilling fluid across the protruding tungsten carbide inserts and thereafter against the formation face. The new nozzle system provides a dual function of first cleaning material from the inserts and second sweeping the cuttings from the bore hole face. This system is particularly advantageous when drilling through those certain types of formations which, because of their softness or ductility, become very plastic during drilling operations, and tend to "ball up" in the spaces between the inserts on the cutters and when used in conjunction with a drill bit having a relatively large offset distance (i.e. greater than that in the above described conventional drill bits). This "balling up" greatly reduces the rate of penetration and the cutting efficiency of drill bits when penetrating such plastic formations. The new nozzle system provides a plurality of fluid jets directed at preselected angles to spray drilling fluid across the inserts without impinging the roller cutter body surfaces, with the stream after flowing past the inserts impinging the formation to clean the portions of the formation surface which will soon thereafter be engaged by the inserts.

Further, one embodiment of the invention is directed to a drill bit construction in which the bit body has generally vertically extending recessed portions formed along its outer surface generally between the lugs forming the bit body to provide increased fluid passageways for the upward flow of drilling fluid and entrained cuttings from the bottom of the well bore for removal of the cuttings. The discharge nozzles or orifices are positioned on the bit body inwardly of the recessed portions for the discharge of high velocity drilling fluid in streams between the roller cutters in a downward flow path spaced from the upward flow path of drilling fluid and entrained cuttings along the fluid passageways in the recessed portions of the bit body shank thereby to minimize interference between the downward flow of high velocity drilling fluid and the upward flow of drilling fluid and cuttings, and to increase the removal rate of the cuttings.

BRIEF DESCRIPTION OF THE DRAWINGS

FIG. 15 being a perspective of a three-cone bit body; FIG. 16 being a schematic in bottom plan of two roller cutters engaging the bore hole bottom; FIG. 17 being a partial side elevation, partly schematic, of one roller cutter engaging the bore hole bottom; FIG. 18 being a plan of one roller cutter and the adjacent surfaces defining the bore hole; FIG. 19 being a partial bottom plan showing a multi-orifice jet discharge nozzle; and FIG. 20 being a side elevation of a single roller cutter showing the multi-orifice nozzle having a slanted jet or formed through the wall of the bit body.

DESCRIPTION OF THE PREFERRED EMBODIMENTS

Figure 1:
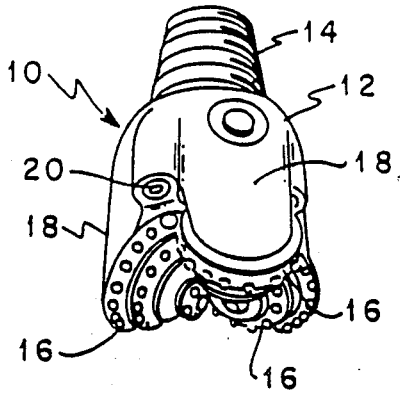
FIG. 1 is a side view of one embodiment of the drill bit of this invention comprising a three-cone bit.
Figure 2:
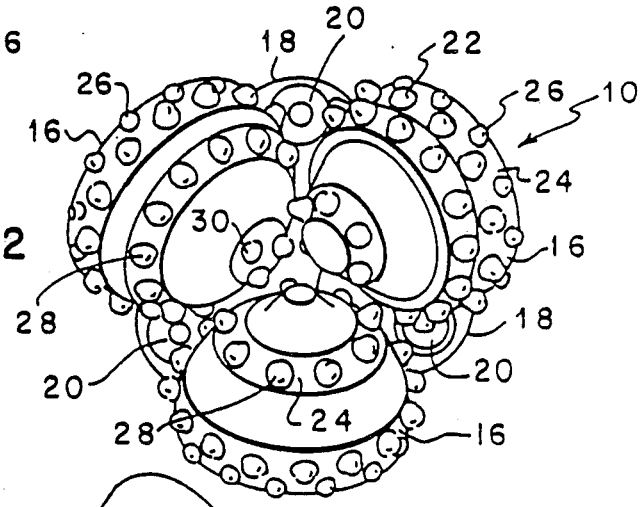
FIG. 2 is an axial bottom view of the three-cone bit of FIG. 1.

Referring to FIG. 1, a first embodiment of the drill bit 10 of this invention is shown in isometric comprising having a central main body section 12 with an upwardly extended threaded pin end 14. The threaded pin 14 comprises a tapered pin connection adapted for threadedly engaging the female end of a drill string and to receive drilling fluid under pressure from the drill string. The body section 12 has three downwardly extending legs 18 formed thereon, on each of which is rotatably mounted a roller cutter 16. A plurality of nozzles 20 (e.g., three nozzles as illustrated) are located at the periphery of the body section 12 angled downward past cutters 16. In FIG. 2, which is an axial view looking up from the bore hole toward the bottom of the bit, the cutters 16 of bit 10 are shown to comprise a generally frustoconical roller cutter body and a plurality of hard metal cutting elements 22 projecting from raised lands 24 formed on the surfaces of the cutter bodies. In a typical embodiment, the inserts are arranged in three different rows, as gauge row inserts 26, intermediate row inserts 28, and nose inserts 30. As is well known in the industry, the inserts are secured in the cones by drilling a hole in the cutter body for each insert with the hole having a slightly smaller diameter than the insert diameter, thus resulting in an interference fit. The inserts are then pressed under relatively high pressure into the holes and the press fit insures that the inserts are securely held in the cones.

Although not shown in the drawings, each cutter 16 is rotatably mounted on a cylindrical bearing journal machined on each leg 8, as is well known in the art. As is also well known in the art, bearings such as roller bearings, ball bearings, or sleeve bearings are located between the cutter and the bearing journal to provide the rotational mounting.

Figure 3:
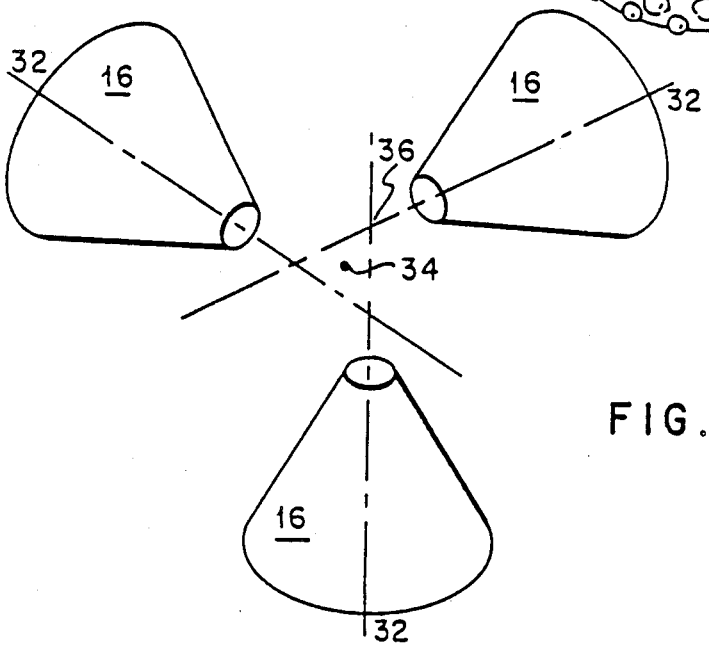
FIG. 3 is a schematic representation of the three cutter cones of the bit of FIGS. 1 and 2, showing the concept of offset cutter axes.

In FIG. 3, the cutters 16 are illustrated schematically as simple frustoconical figures. Each cutter cone 16 has an axis of rotation 32 passing substantially through the center of the frustoconical figure. The central rotational axis of the bit 10 is illustrated as point 34 in FIG. 3 since FIG. 3 is taken from a view looking directly along the rotational axis of the bit. From FIG. 3, it can be seen that because of the offset of axes 32, none of the axes intersect axis 34 of the bit. In this flat projection, the intersection of the axes 32 forms an equilateral triangle 36. The amount of offset for a bit is the distance from axis 34 to the mid-point of any side of triangle 36. Preferably, the amount of offset is greater than about 1/16 inch of offset per inch of drill bit diameter and less than about ⅛ inch of offset per inch of drill bit diameter. This is in sharp a contrast to the commonly accepted theory that the optimum offset is approximately 1/32 inch of offset per inch of bit diameter and that offsets greater than the optimum result in reduced rates of penetration and thus are undesirable.

Figure 4:
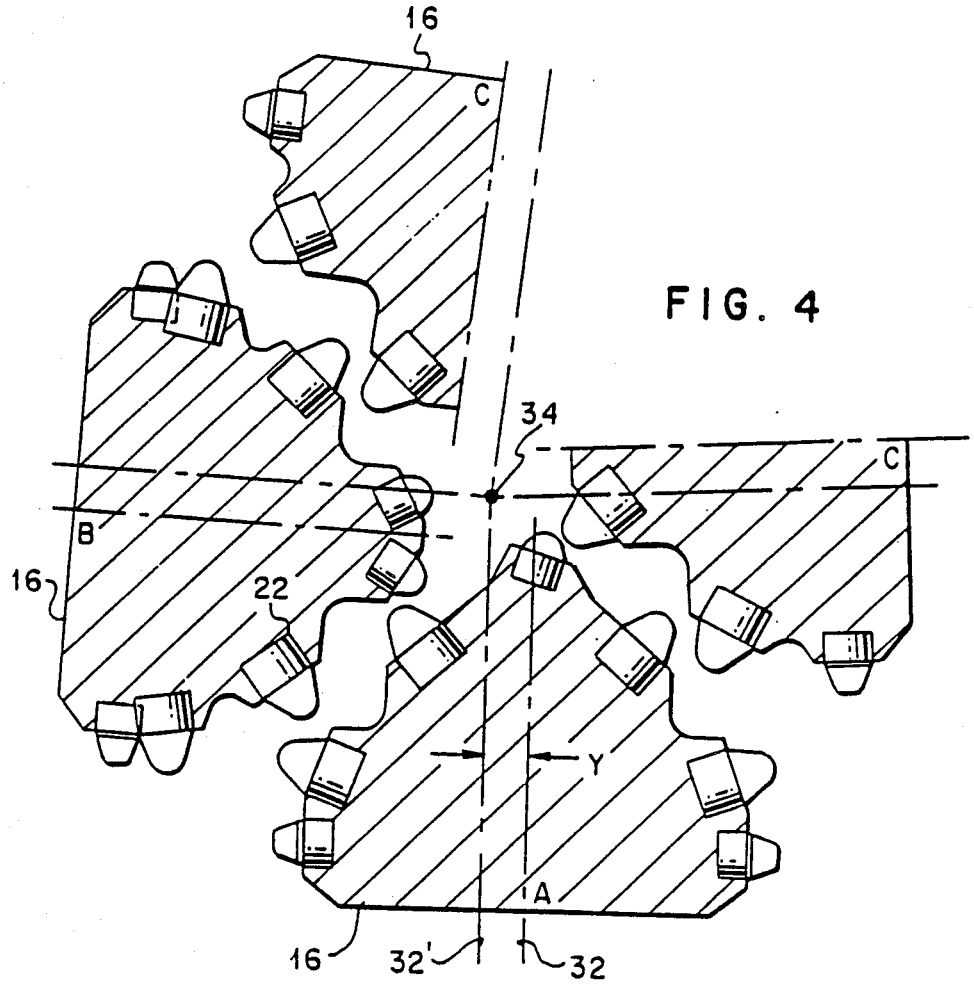
FIG. 4 is a diagram of the cutter configuration in one embodiment of the invention illustrating the location and placement of the inserts in the cutter and also indicating the offset of the cutters.

Referring now to FIG. 4, in which a cutter layout is illustrated, the profiles or cross-sections of each of the cutters on the tri-cone bit of the preferred embodiment are laid out in relation to each other to show the intermesh of the cutting elements or inserts 22. Generally, each cutter in a tri-cone cone bit is of a slightly different profile in order to allow optimum spacing of the inserts for the entire bit. In FIG. 4, the three cutters are labeled A, B and C. The C cutter has been divided to illustrate its intermesh with both cutters A and B. It should be noted that the projections have been flattened out, and because of the two dimensional aspect of this relationship, a distortion in the true three dimensional relationship of the cutters is necessary. In FIG. 4, the central axis of rotation 34 of the bit is indicated. Each cutter A, B and C, has a rotational axis 32 which is offset by a distance Y from an imaginary axis 32' which is parallel to the actual axis 32 and passes through point 34 which is the bit rotational axis.

Figure 5:
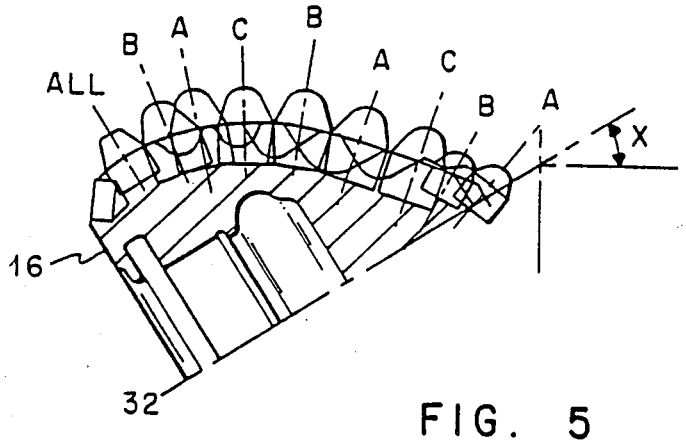
FIG. 5 is a schematic diagram showing an overlay of the insert pattern of all three cutters of FIG. 4 to show bottom hole coverage of the bit.

FIG. 5 is a cutter profile which is an overlay of one-half of each of the cutters A, B and C to indicate the placement of all of the inserts with respect to bottom hole coverage. Each insert in the profile of FIG. 5 is labeled according to the particular cutter cone in which the insert is located. The angle X is indicated to show the journal angle of the bit. The journal angle is the angle that the bearing journal axis, which coincides with the rotational axis 32 of the cutter, makes with a plane normal to the bit rotational axis 34.

In this particular embodiment it was found that the preferred range of insert protrusion above the cutter surface should be greater than or equal to about one-half the diameter of the insert. Any protrusion significantly less than one-half the diameter would make the gouging and scraping action resulting from the large amount of offset ineffective. The preferred range of insert protrusion is from one-half to one times the insert diameter. The preferred shape of the protruding portion of the insert is conical or chisel. Acceptable alternate shapes are the hemispherical and the sharpened hemispherical inserts.

The inserts may be made of a suitable powder metallurgy composite material having good abrasion and erosion resistant properties, such as titanium carbide, tantalum carbide, chromium carbide, or tungsten carbide in a suitable matrix. The preferred embodiment utilizes tungsten carbide in a cobalt matrix. The cobalt content ranges from about 5% to about 20% by weight of the insert material, with the remainder of the metal being either sintered or cast tungsten carbide, or both. The hardness of the inserts is controlled by varying the cobalt content and by other well known methods. The hardness ranges from about 85 Rockwell A to about 90 Rockwell A. In one particular embodiment, conical inserts having a protrusion greater than one-half of their diameter were used, with the inserts being made of tungsten carbide-cobalt alloy, having a cobalt content of around 12% and a hardness of about 86.5 Rockwell A.

Figure 6:
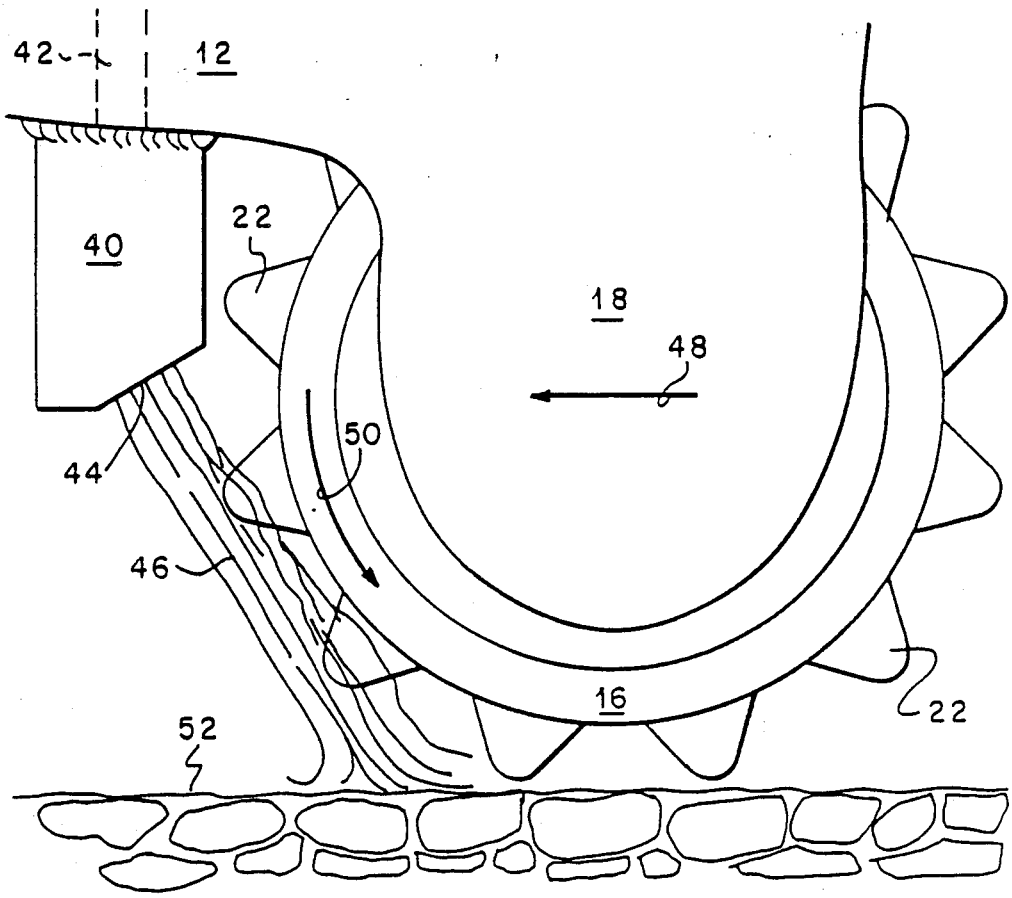
FIG. 6 is a schematic illustration of the directed nozzle system of the bit and its interaction with a roller cutter and the formation.

Referring now to FIG. 6, a schematic sketch of the directed nozzle fluid system of the invention is illustrated. In FIG. 6, a generally cylindrical jet nozzle 40 is shown connected to bit body 12 and communicating with a high pressure drilling fluid passage 42 passing therethrough. Nozzle 40 has an exit jet or nozzle 44 from which high pressure drilling fluid 46 is emitted in a concentrated stream flowing generally toward the underside of the adjacent roller cutter 16 (i.e., the half of the roller cutter below its longitudinal axis or axis of rotation 32). Bit leg 18 is illustrated having conical cutter 16 located thereon. A direction arrow 48 is drawn on leg 18 to indicate the direction of movement of the bit leg in the bore hole as the drill bit is rotated. Likewise, a second rotation arrow 50 is drawn on cutter 16 to indicate the simultaneous rotation of cutter 16 with movement of bit 10 in the bore hole. The high-pressure drilling fluid stream 46 is directed by passaging in the nozzle 40 in a predetermined direction such that the fluid stream is either tangent with the surface of the roller cutter body or slightly displaced therefrom as shown in the drawing. The placement of stream 46 in a tangential relationship with cutter 16 allows effective cleaning of inserts 22 as they move through stream 46, but also prevents abrasive erosion of the steel cutter shell 16 which would occur if the stream impinged it directly. Although the preferred embodiment is to have stream 46 either tangential to or slightly displaced from cutter shell 16, a slight impingement of 46 with cutter shell 16 is also contemplated in that such impingement would not be highly detrimental due to the very slight angle of incidence of stream 46 against the cutter surface. After fluid stream 46 passes the inserts it impinges the bottom 52 of the bore hole and travels along the bottom picking up cuttings that were chipped and gouged from the formation by inserts 22. The drilling fluid then passes below the cutter 16 and moves back upward outside the drill bit and up through the bore hole in the conventional manner.

Thus, the passaging in the nozzles is so angled relative to the bit body and roller cutters that the nozzles direct the drilling fluid under pressure to exit downwardly and in the direction opposite to the direction of rotation of the bit, indicated by arrow 48 in FIG. 3. As earlier described, the fluid flows in a high velocity stream 46 at an angle relative to the longitudinal axis 34 of the bit body adjacent to the cutter body of the adjacent roller cutter, which is typically of steel alloy which has a relatively low resistance to erosion by high velocity streams of drilling fluid. As the fluid flows past the cutters, it impinges inserts of the gage row of inserts and the row adjacent thereto. Being formed of tungsten carbide material having a high erosion resistance, the inserts, however, are not subject to significant erosion by the stream of high velocity drilling fluid. After flowing past the roller cutter, the stream 46 of drilling fluid then impinges portions of the bottom 52 of the well bore closely adjacent to, but spaced apart from (i.e., ahead or forward with respect to the direction of rotation 48 of the drill bit) all of the points of engagement of the inserts of the adjacent roller cutter with the bottom of the bore. These portions of the well bore bore are cleaned by the high velocity fluid, thereby exposing a clean surface at the bottom 52 prior to its engagement by an insert 22.

It will be observed from the foregoing that the nozzles direct the drilling fluid under pressure to flow downwardly in a stream so angled and positioned relative to the adjacent roller cutter that as the roller cutter rotates cutting elements or inserts thereon enter the stream for being cleaned thereby and then exit the stream, with the stream after flowing past the cutting elements impinging the formation at the bottom of the well bore. Thus the formation and all of the cutting elements impinged by the stream are subjected to separate cleaning actions immediately prior to their engagement for presenting clean engagement surfaces. These separate or sequential cleaning actions have been found to result in enhanced drill bit cutting action and increased rates of drilling penetration; particularly in drilling sticky formations or formations that become ductile or plastically deformable in over balanced pressure conditions, and when used in conjunction with a drill bit having a relatively large offset distance, i.e., greater than that of the above described conventional drill bit such as applicants' drill bit having 1/16 to ⅛ inch of offset per inch of bit diameter. In this latter regard and as described above, an unwanted side effect of the high degree of offset is an increased tendency for the cut formation to adhere to the roller cutters of the bit (i.e., an increased tendency to "bit ball"). The cleaning of the inserts on the roller cutters immediately prior to their engagement with the formation has been found to be effective in preventing bit balling in high offset bits, even when used to drill sticky or ductile formations. Moreover, the cleaning of areas of the formations at the bottom of the well bore to be engaged by the inserts immediately prior to the engagement has been found to be effective in presenting a clean engagement surface, even when there is severe "chip hold down".

The drill bit 10 of this invention thus represents a significant improvement over conventional drill bits of the type such as shown in U.S. Pat. No. 3,495,668, in which the nozzles extend generally vertically down between adjacent roller cutters. Being so angled, these nozzles direct the drilling fluid so as not to impinge the roller cutters but, rather, only to impinge the formation at areas substantially forward of the roller cutter. The drill bit 10 also represents an improvement over drill bits of the type, such as shown in U.S. Pat. No. 4,106,577 and British Patent No. 1,104,310, in which the nozzles direct the drilling fluid so as to simultaneously engage the cutting elements of the roller cutter and the bottom of the well bore (i.e., engage the cutting elements only at their points of engagement with formation).

Figure 7:
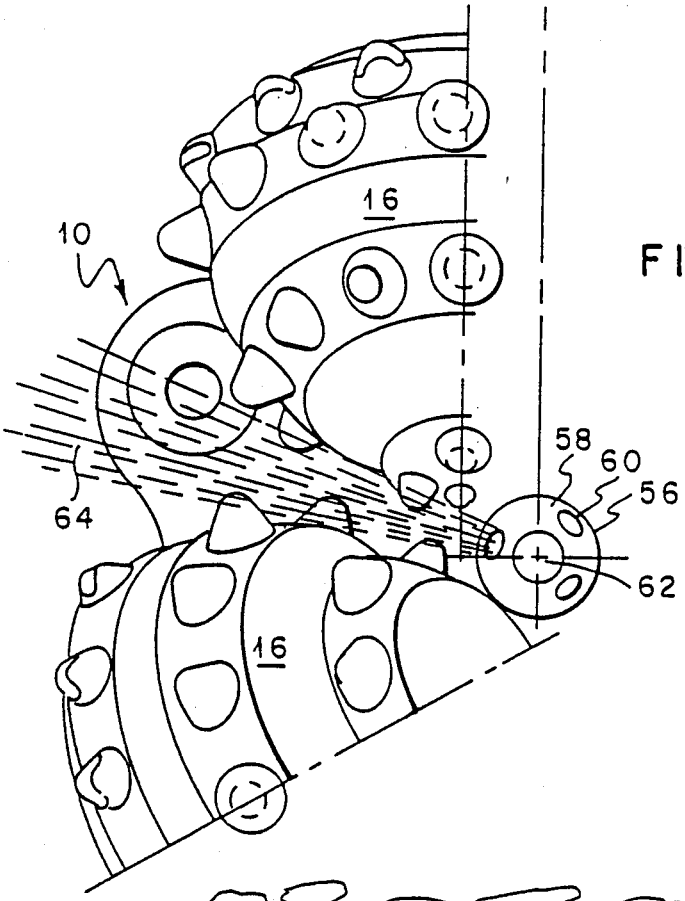
FIGS. 7 and 8 are illustrations of a second embodiment of the bit of this invention having a directed nozzle system, FIG. 7 being an axial end view of a central nozzle system, and FIG. 8 being a partial cross-sectional side view of the nozzle of FIG. 7.
Figure 8:
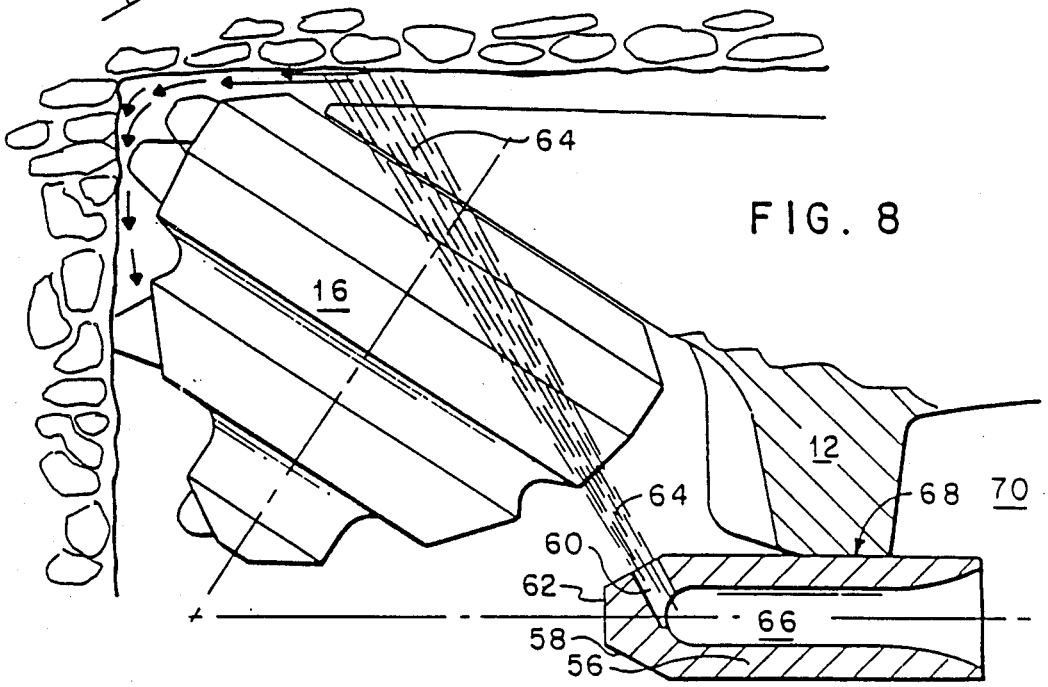

Referring now to FIGS. 7 and 8, a second embodiment of the directed nozzle system is disclosed. This embodiment utilizes a multi-orifice jet nozzle which protrudes downwardly from the central area of the bit body toward the central area between the three conical cutters. FIG. 7 is a partial axial end view of the bit 10 illustrating two cutters 16 and the location of the multi-orifice jet or nozzle 56. Jet 56 is generally cylindrical in nature having a bevelled edge 58 at the downward projecting end thereof and having three nozzle openings 60 formed through the bevelled surface 58. A flat, closed end 62 is located at the bottom of the nozzle. A fluid stream 64 is shown emanating from one of the openings 60. This spray passes across the inserts in the cutters 16 without impinging the roller cutter body surfaces. The stream cleans any packed cuttings which may be lodged between the various inserts and then moves outward and then downward to sweep the bottom of the bore hole in front of the cutters as they roll into the formation surface. FIG. 8 is a partial side view of the bit of FIG. 7 showing a single cutter 16 and the multijet nozzle 56. In this figure, the nozzle 56 is shown in a cross sectional diagram and it can be seen that the nozzle has a central passage 66 which communicates with the nozzle openings 60. Nozzle 56 is securely located in a bore 68 formed in bit body 12. Bit body 12 has a fluid cavity 70 formed therein which communicates with threaded pin end 14 which also is tubular in nature. Thus, it can be seen that drilling fluid pumped down the drill string passes through threaded pin 14 into bit cavity 70, through nozzle bore 66 and out the nozzle opening 60 into a jet or spray 64 which impinges the major cutting inserts on cone 16 and then is directed either against the face of the bore hole or, as shown in FIG. 8, may be directed against the wall of the bore hole whereupon the fluid moves down the wall and across the formation at the bottom of the well bore to pick up additional loose cuttings thereon.

Figure 9:
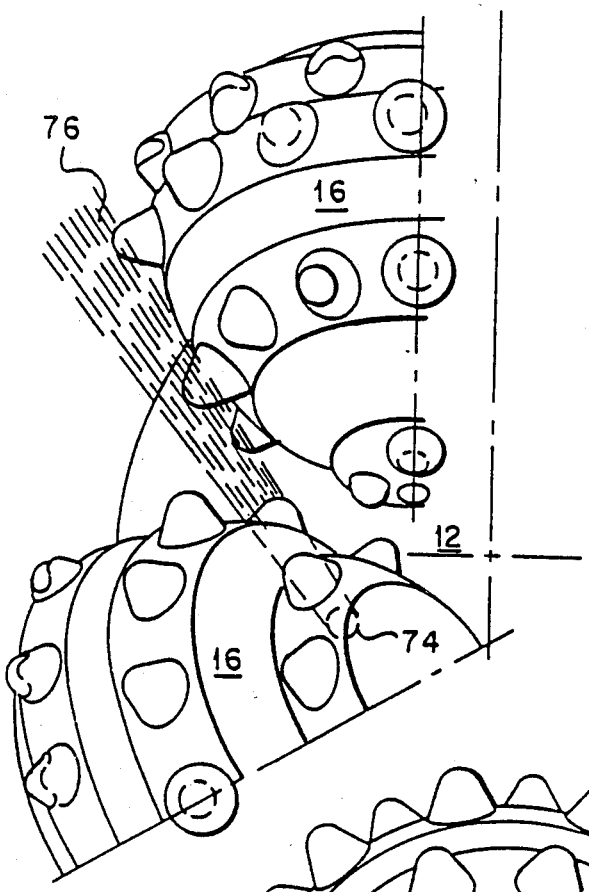
FIGS. 9 through 11 are different views of a third embodiment of the drill bit of this invention utilizing an intermediate jet.
Figure 10:
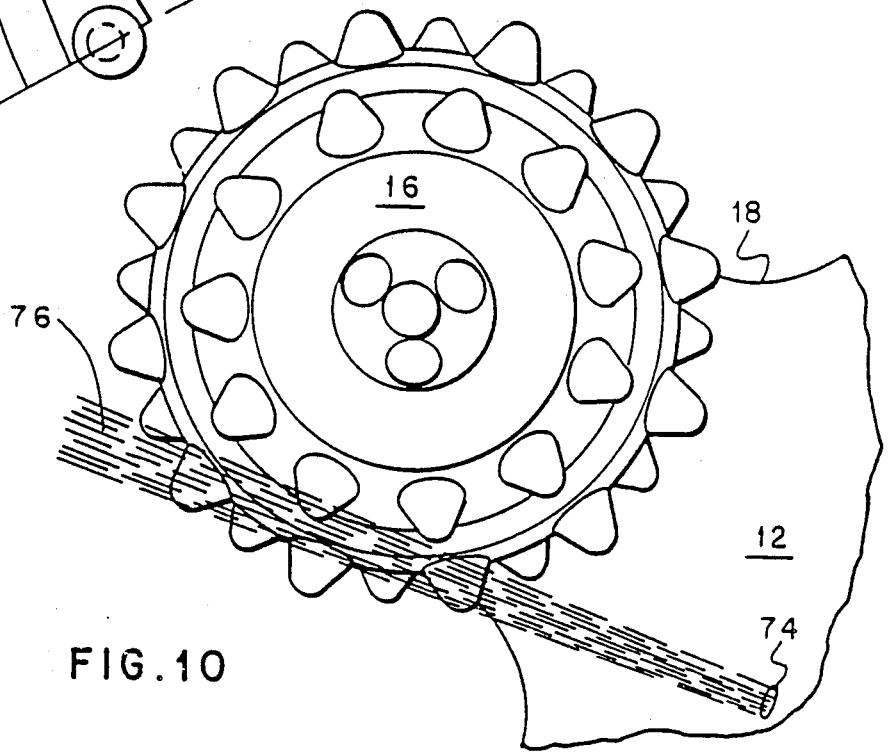
Figure 11:
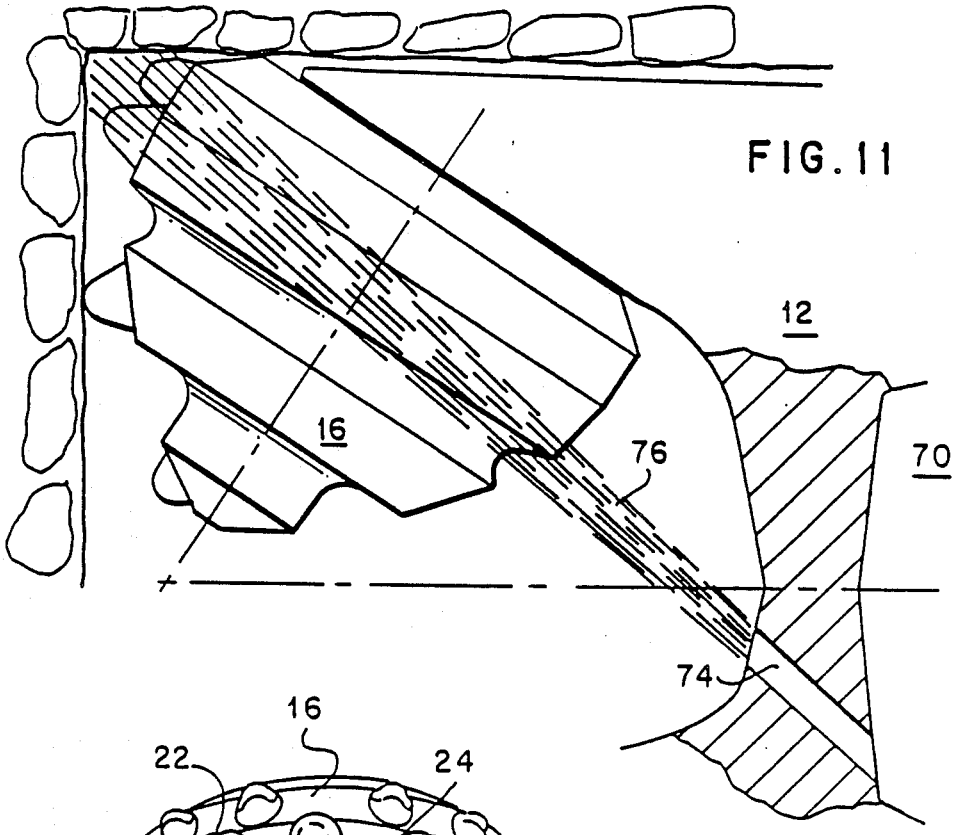

Referring now to FIGS. 9 through 11, a third embodiment of the directed nozzle system is disclosed in which the fluid jetting system is directed across the main cutting inserts and impinges directly upon the well bore bottom. In this embodiment, the projected nozzle arrangement is replaced by a slanted jet configuration formed through the wall of the bit body 12 and communicating with bit cavity 70. FIG. 9 is a partial axial view showing part of two cutter cones 16, the bit body 12 and a directed jet passage 74. The drilling fluid is emitted from jet passage 74 in a stream 76 which impinges the major cutting inserts on cones 16 and passes downward to impinge the bottom of the bore hole. In this embodiment three of the jet passages 74 are formed in bit body 12 so that each conical cutter 16 has one jet passage associated therewith for sweeping cuttings from the inserts and impinging the bottom of the bore hole. FIG. 10 is a side view of one cutter looking from the central axis of the bit radially outward at the cutter. Jet passage 74 passes through bit body 12, communicating with the drilling fluid in the drill string by means of cavity 70 and pin 14. In FIG. 11 one of the three jet passages 74 is shown in communication with cavity 70 and emitting a jet stream 60 of drilling fluid passing across the cutting inserts of cutter 16 and impinging the bore hole bottom.

Figure 12:
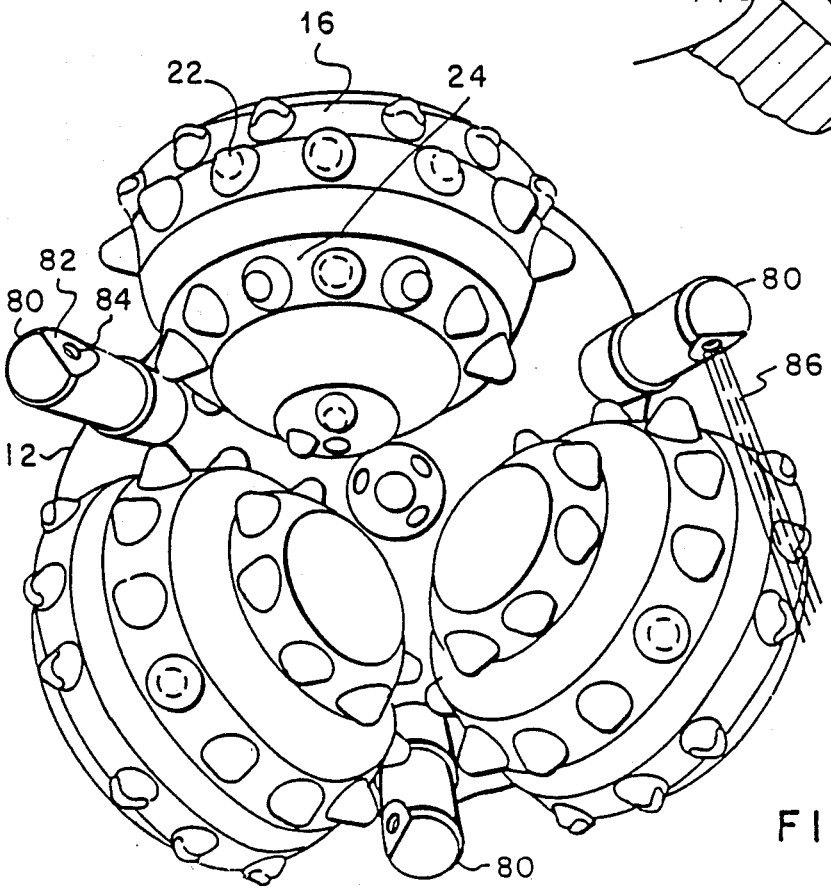
FIGS. 12 through 14 illustrate axial bottom views of a fourth embodiment of the drill bit of this invention which utilizes a peripheral directed nozzle system.
Figure 13:
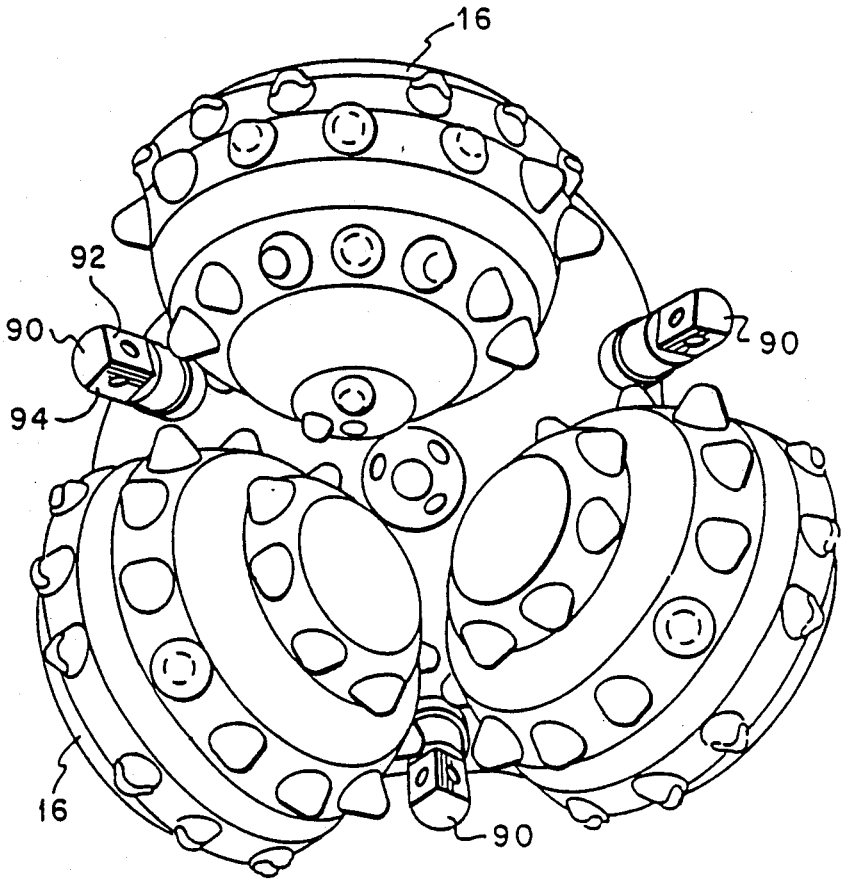
Figure 14:
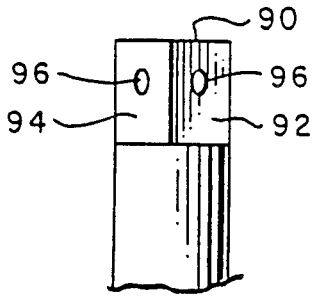

Referring to FIGS. 12 through 14, two further embodiments of the directed nozzle system of the present invention are shown. In FIG. 12 a drill bit is shown in the axial view looking up from the bottom of the bore hole. The bit has three conical cutters 16 having a plurality of tungsten carbide inserts 22 securely held in raised lands 24 on the cutters. A set of three peripherally directed nozzles 80 are located around the outer periphery of bit body 12, extending downward therefrom into the generally open areas between the outer rows of inerts on the conical cutters. The embodiment of FIG. 12 utilizes the three directed nozzles which are generally cylindrical in nature, each having a bevelled face 82 and a nozzle passage 84 formed through face 82 and communicating with central bore passage in nozzle 80. Nozzle passage 84 is formed such that a directed spray of fluid 86 is emitted therefrom which impinges across the main cutting inserts of the conical cutters which are located clockwise from each nozzle 80. Each nozzle passage 84 is aimed in a generally circumferential direction with respect to bit body 12 and in a tangential direction to cutter cones 16 such that the fluid spray emitted therefrom does not impinge squarely on the cone 16. Each nozzle 80 having the single jet passage 84 is arranged to clean the inserts on the cutter located in a clockwise direction from the nozzle. After the spray passes across the main cutting inserts, it is directed against the bottom of the bore hole to further provide cleaning action during the drilling operation. In FIG. 13, a slightly different embodiment of the peripheral nozzle system is disclosed in which three double jet nozzles 90 are located around the periphery of the bit bottom extending downwardly therefrom between the outer edges of the cones 16. Each nozzle 90 has two nozzle passages formed therein passing through opposed bevelled faces 92 and 94. Thus, each nozzle 90 has a jet passage directed at each cutter cone 16 located adjacent thereto. FIG. 14 is a diagrammatic sketch showing the nozzle 90 from the side and illustrating the two bevelled faces 92 and 94. The jet passages 96 pass through the two bevelled faces and communicate with an inner bore in nozzles 90. Pressurized drilling fluid passes through the drill bit and into the nozzles 90 in a manner similar to that of the embodiment shown in FIG. 12.

Referring to FIGS. 15–20, another embodiment of the invention is illustrated showing a drill bit construction in which the bit body is free of nozzle means or fluid orifices along the periphery of the shank of the bit body. The elimination of nozzle means from this area provides a space for locating generally vertically extending recessed portions along the outer surface of the bit body shank at the junctures generally of the three lugs forming the bit body thereby to provide fluid passageways for the upward flow of drilling fluid and entrained cuttings from the bottom of the well bore for removal of the cuttings. The discharge nozzles or orifices are positioned in this embodiment for the discharge of high velocity drilling fluid (i.e. streams flowing at a rate of at least one hundred (100) feet per second) in streams between the roller cutters along a downward flow path spaced from the upward flow path of cuttings along the fluid passageways in the recessed portion of the bit body thereby to minimize interference between the downward flow of high velocity drilling fluid and the upward flow of cuttings for increasing the removal rate of the cuttings.

Figure 15:
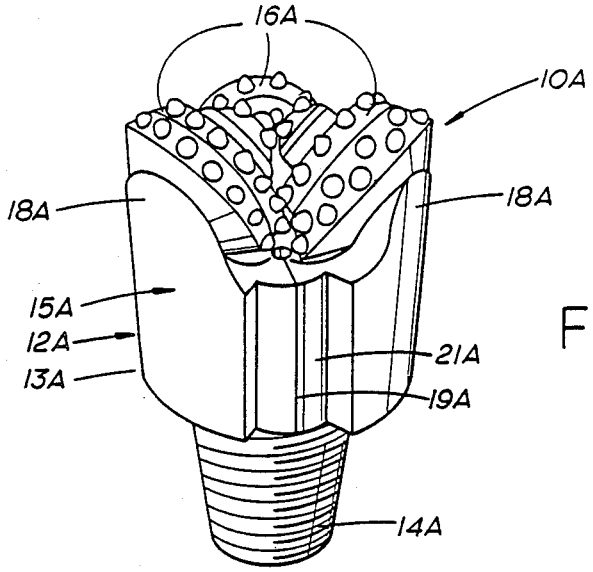
FIGS. 15 through 20 are illustrations of a fifth embodiment of the drill bit of this invention in which recessed portions in the outer surface of the bit body provide flow passageways for the upward outward flow of drilling fluid and cuttings from the well bore bottom.
Figure 16:
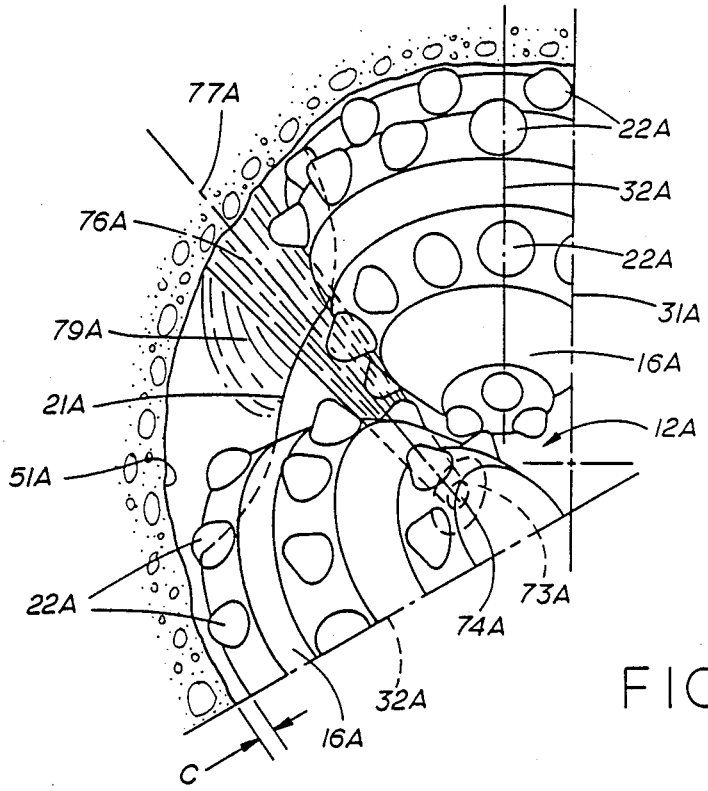

Referring now particularly to FIG. 15, a drill bit 10A is shown having a main bit body 12A with an upwardly extending threaded pin 14A. Main body 12A is formed from three integral connected lugs to define an upper shank 13A below pin 14A and three downwardly extending legs 18A. Lugs 15A each have lateral faces (not shown) extending in a vertical plane with adjacent lateral faces of adjacent lugs 15A being welded to each other along a juncture between lugs 15A shown at 19A to form bit body 12A. Each lug 15A has an outer contour or surface extending for one hundred twenty (120) degrees between its lateral faces. Formed generally at each juncture 19A between lugs 15A is a recessed portion indicated generally at 21A which interrupts the generally smooth outer circumference of bit body 12A formed by the outer surfaces of lugs 15A at upper shank 13A. Each recessed portion 21A extends in a generally vertical direction generally along the juncture 19A formed by adjacent lugs 15A and provides an upward flow passageway for drilling fluid and entrained cuttings from a bore hole bottom 52A.

In order to increase the removal rate of the cuttings from bottom 52A of the bore hole, it is highly desirable under certain operating conditions that the path of the discharge stream of high velocity drilling fluid impinging the bore hole bottom 52A be separated and occupy a different area from the path or upward flow of dilling fluid and entrained cuttings being removed from bore hole bottom 52A. Since the main upward flow stream of drilling fluid and cuttings will be directed through the generally vertical flow passages formed by recessed portions 21A of bit body 12A, it is highly desirable that the discharge nozzle be positioned so that minimal interference or overlapping occurs between the main downward and upward flow streams. Additionally, it is highly desirable that the nozzles or orifices direct the high velocity drilling fluid between a pair of adjacent roller cutters 16A for first impinging cutting elements 22A on the leading face of one roller cutter 16A and thereafter impinging the well bore bottom 52A in an area thereof between a pair of roller cutters 16A.

Figure 17:
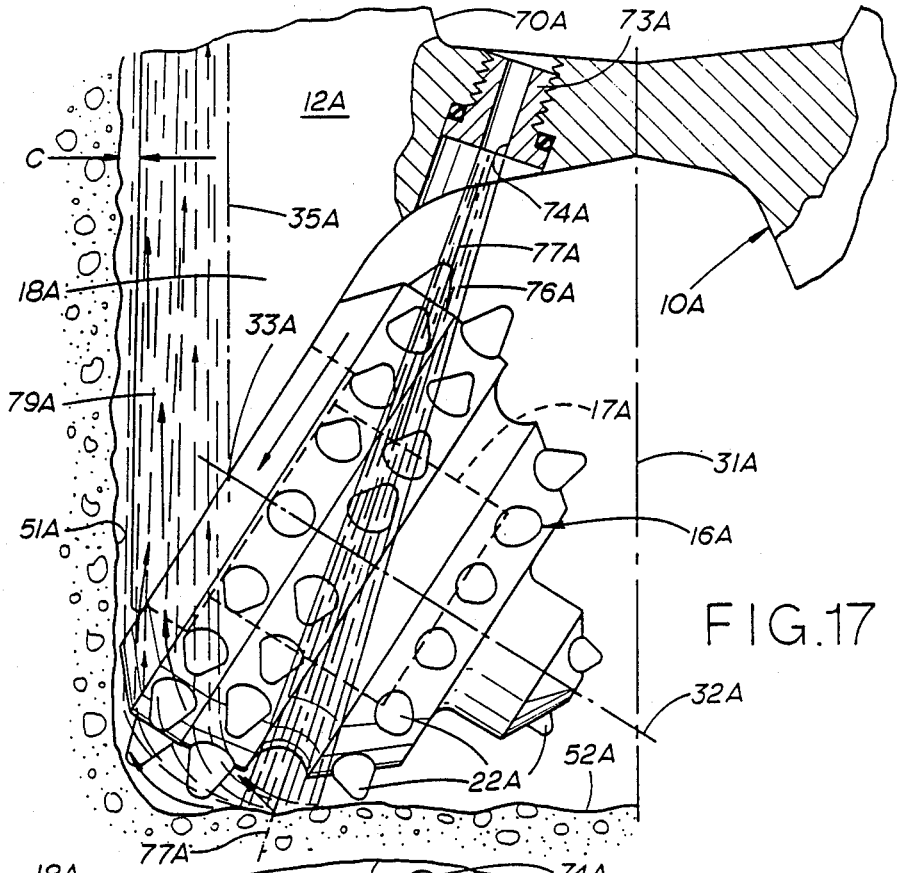

Roller cutter 16A as shown particularly in FIG. 17 is mounted for rotation about an associated journal 17A having an attached and a free end. Cutting elements or inserts 22A are arranged in spaced annular rows on each roller cutter 16A. Certain rows of inserts 22A on adjacent roller cutters 16A are staggered with respect to adjacent rows of cutting elements 22A on adjacent roller cutters 16A for fitting therebetween.

The longitudinal axis of journal 17A is illustrated at 32A with the axis of rotation of drill bit 10A illustrated at 31A. The longitudinal axis 32A of journal 17A at its attached end intersects leg 18A at a point 33A. Upon rotation and downward movement of drill bit 10A, point 33A of journal 17A circumscribes a cylindrical surface which forms within its circumference a central portion of bit body 18A illustrated at 35A. Discharge nozzles or orifices for the high velocity drilling fluid are arranged at a location inwardly of the central portion 35A of bit body 12A defined within the circumscribed cylindrical surface.

Figure 18:
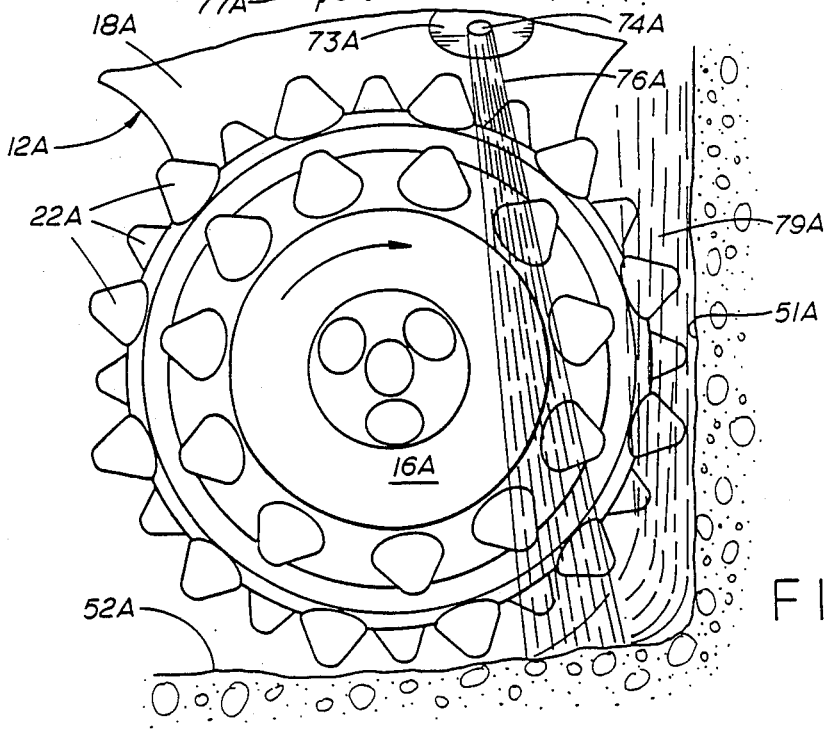

As shown in FIGS. 17 and 18, a nozzle 73A has a slanted orifice or orifice passaging 74A slanted relative to the longitudinal centerline of drill bit 10A. Drilling fluid from bit cavity 70A communicates with orifice 74A and drilling fluid is discharged or emitted from orifice 74A in a stream 76A which impinges first against the leading face of roller cutter 16A along a surface area in the upper one hundred eighty (180) degrees of contour or circumference of the associated roller cutter 16A, and thereafter impinges well bore bottom 52A in an area between a pair of roller cutters 16A. The stream is generally in a plane perpendicular to the longitudinal centerline of the respective journal 17A. The longitudinal axis of stream 76A is shown at 77A and defines the center of the volume of the discharge fluid which impinges bore hole surface 52A at a location a substantial distance from the adjacent cylindrical wall 51A of the bore hole. It is noted that a clearance C is provided between the adjacent outer surface of lugs 15A and cylindrical wall 51A. Clearance C adjacent the shank 13A is normally less than around ¼ inch and thus, recessed portions 21A provide a substantial flow area inwardly of the outer surface of bit body 12A for receiving the upward flow of drilling fluid and entrained particles shown at stream 79A. Preferably at least one discharge stream of high velocity drilling fluid is provided between each of the adjacent roller cutters 16A. Thus, at least three nozzles 73A or orifices 74A should be provided. The upward stream of drilling fluid and entrained cuttings illustrated at 79A thus passes in a minor portion through clearance C and in a major portion through the adjacent recessed portions 21A formed in bit body 12A.

Figure 19:
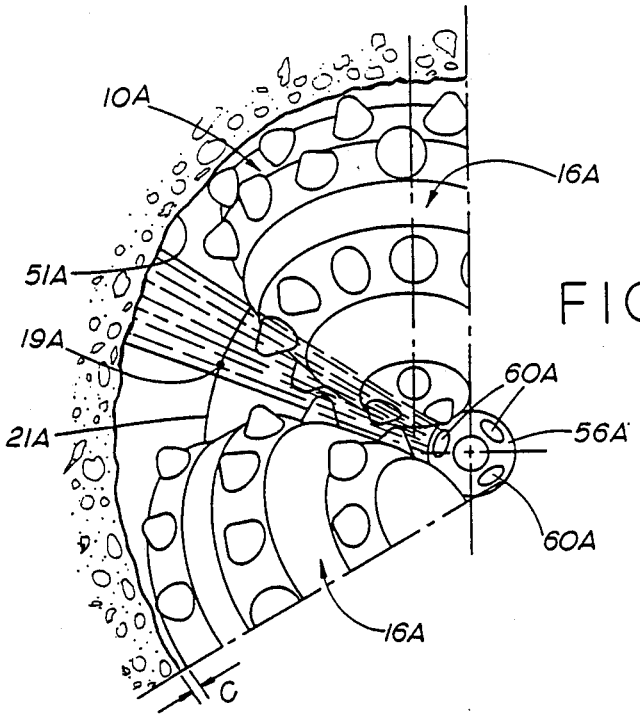
Figure 20:
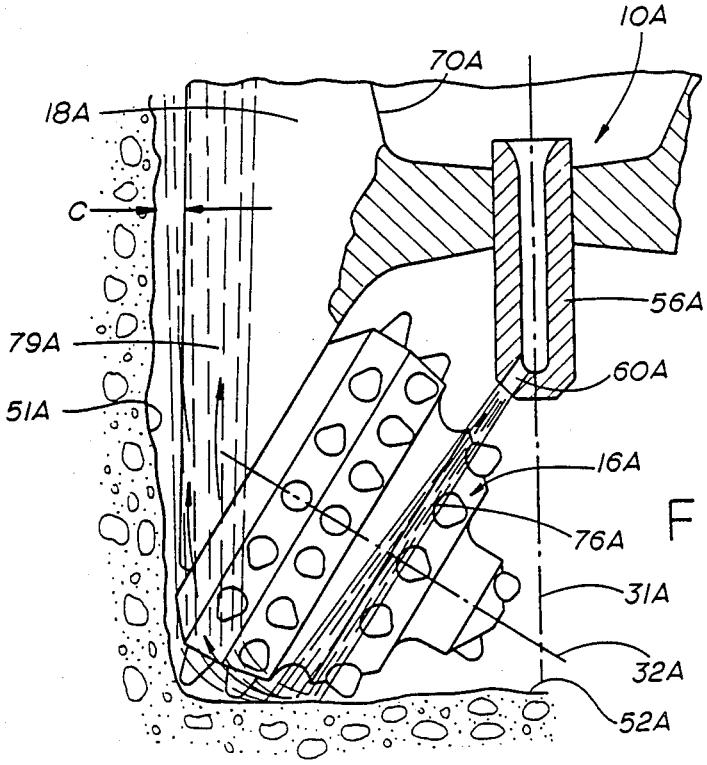

Referring now to FIGS. 19 and 20, another embodiment of a nozzle system is disclosed utilizing a multi-orifice jet nozzle illustrated at 56A and including three spaced orifices 60A each of which is directed to an area between a pair of adjacent roller cutters 16A. Nozzle 56A has its longitudinal axis in alignment with the rotational axis 31A of drill bit 10A. Thus, a single nozzle 56A having three slanted orifices 60A provides three separate streams 76A of high velocity drilling fluid, each directed first against the leading face of one roller cutter 16A and then impinging the well bore bottom 52A in an area between a pair of roller cutters 16A. Discharge nozzles or orifices 60A are positioned radially inwardly from recessed portions 21A formed in bit body 12A.

The nozzles utilized in the embodiments of this invention are preferably formed of a hard material such as tungsten carbide in a cobalt matrix. The tungsten carbide-cobalt alloy may be of the type using sintered tungsten carbide, cast tungsten carbide, or a combination of both. Alternatively, the nozzles could be formed of any other suitable material having good erosion resistant properties.

The remaining features of the embodiment of the invention shown in FIGS. 15–20 are generally similar to those set forth for the embodiments shown in FIGS. 1–14.

Thus, the present invention defines several unique features, one of which is the utilization of a heretofore unknown high degree of offset of the cutter axes of an insert type bit. Another feature is the novel fluid nozzle system which provides a highly efficient cleaning of the protruding inserts as well as a cleaning of the formation face as it is being drilled. This system directs the high pressure fluid stream at or near a tangent to the cutter cones in a position to sweep the inserts, thereby cleaning any balled up material therefrom, and the fluid stream thereafter passes from the insert region to the formation at the bottom of the bore hole thereby subjecting the formation and the inserts to separate, sequential cleaning actions.

Thus, as the roller cutters rotate, the cutting elements thereon enter the respective stream of drilling fluid for being cleaned thereby and then exit the stream prior to engaging the formation, with the stream after flowing past the cutting impinging the formation generally at the bottom of the well bore.

In the embodiment of FIGS. 15–20, enhanced transport of the chips cleaned from the roller cutters and well bore bottom is provided by directing the streams of drilling fluid radialy outwardly first in a downward direction to clean the roller cutters and the well bore bottom and then in an upward direction. The downward and upward flow paths are spaced apart and thus are substantially free of interference from each other for enhanced chip transport.

Although certain preferred embodiments of the present invention have been herein described in order to provide an understanding of the general principles of the invention, it will be appreciated that various changes and innovations can be effected in the described drill bit structure without departure from these principles.

What is claimed is:

1. A triple cone rotary drill bit for drilling a well bore, said bit comprising:

a bit body having a threaded pin at its upper end adapted to be detachably secured to a drill string for rotating the bit and delivering liquid drilling fluid under pressure to the bit, a shank below said pin, and three legs below said shank at the lower end of the bit body, each leg having a downwardly and generally radially inwardly extending cylindrical journal having an attached end and a free end;

nozzle means having a plurality of nozzle orifices for exit of liquid drilling fluid from the bit in a plurality of high velocity liquid streams flowing at a rate of at least one hundred (100) feet per second;

three roller cutters, one for each leg, each roller cutter comprising a generally conical roller cutter body mounted on the respective leg for rotation about the longitudinal centerline of the journal and a plurality of cutting elements on the roller cutter body, each cutting element at least at a portion of its surface being formed of a material resistant to erosion by a high velocity stream of drilling fluid which may impinge it, the cutting elements of each roller cutter being arranged in spaced relation around the roller cutter body in a predetermined pattern;

the centers of the journals at their attached ends to said legs defining upon rotation of the bit a cylindrical surface of revolution about the longitudinal axis of the bit body which constitutes a central portion of the bit body;

the nozzle means being mounted on the underside of the bit body, with the orifices thereof being disposed within said central portion of the bit body and directing each of the streams of high velocity drilling fluid from the bit body downwardly such that each stream of drilling fluid flows generally between a pair of adjacent roller cutters and impinges cutting elements on the leading face of one roller cutter of said pair of roller cutters generally above the longitudinal centerline of the respective journal of said one roller cutter, and thereafter impinges at high velocity the well bore bottom in an area thereof between said pair of roller cutters in advance of engagement of such impinged bore bottom by said one roller cutter, the cutting elements on said one roller cutter entering a portion of the stream for being cleaned and then exiting said portion of the stream prior to engaging the bore bottom;

the drill bit being free of nozzle orifices positioned outside of said central portion with the bit body having a portion of the outer surface of the shank thereof within a vertical projection above each said area of the well bore bottom recessed radially from the wall of the well bore, to provide an upwardly extending fluid passageway of relatively large cross sectional area between the wall of the well bore and the entire height of the shank such that each stream of drilling fluid flows first in a downward direction such that the stream impinges at least a plurality of cutting elements on said one roller cutter and thereafter impinges at high velocity a portion of the well bore bottom to be engaged by cutting elements on said one roller cutter for enhanced removal of cuttings from said one roller cutter and the well bore bottom, and then flows in an upward direction from the well bore bottom in a path spaced from the path of the downward stream for enhanced transport of these cuttings away from the well bore bottom, with the downward and upward flow of the streams of drilling fluid thus being substantially free of interference from each other.

2. A tri-cone rotary drill bit as set forth in claim 1 wherein the nozzle means comprises a plurality of nozzle members, each nozzle member having passaging and a nozzle orifice therein.

3. A tri-cone rotary drill bit as set forth in claim 1 wherein the nozzle means comprises a nozzle member having a plurality of nozzle orifices therein mounted on the underside of the bit body generally on the longitudinal centerline thereof.

* * * * *